US011999527B2

(12) United States Patent
Tsukada et al.

(10) Patent No.: US 11,999,527 B2
(45) Date of Patent: Jun. 4, 2024

(54) SUPPORTER AND CARRIER

(71) Applicant: FUJIFILM Business Innovation Corp., Tokyo (JP)

(72) Inventors: Shigeru Tsukada, Kanagawa (JP); Taisuke Endo, Kanagawa (JP); Hiroyuki Kono, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 190 days.

(21) Appl. No.: 17/546,023

(22) Filed: Dec. 8, 2021

(65) Prior Publication Data

US 2023/0023277 A1 Jan. 26, 2023

(30) Foreign Application Priority Data

Jul. 20, 2021 (JP) ..... 2021-119209

(51) Int. Cl.
*B65D 19/44* (2006.01)

(52) U.S. Cl.
CPC .... *B65D 19/44* (2013.01); *B65D 2519/00815* (2013.01)

(58) Field of Classification Search
CPC ..... B65D 19/44; B65D 2519/00815; B65D 81/02; B65D 2519/00333; B65D 2585/6897
USPC .... 248/499, 500, 501, 502, 506, 509, 503.1, 248/505, 510, 346.03, 346.04
See application file for complete search history.

(56) References Cited

U.S. PATENT DOCUMENTS 1,543,253 A * 6/1925 Gerwig ..... B41J 29/04 248/680
2,651,483 A * 9/1953 Ritchie ..... B41J 29/04 248/500
2,925,861 A * 2/1960 Long ..... E06B 9/325 248/500
3,125,177 A * 3/1964 Paller ..... H01M 50/264 180/68.5
RE28,035 E * 6/1974 Fork ..... H02G 3/283 248/500
5,690,311 A * 11/1997 Leighton ..... F16M 11/42 248/500
5,890,693 A * 4/1999 Do ..... G06F 1/184 248/500

(Continued)

FOREIGN PATENT DOCUMENTS

JP H1095429 4/1998

*Primary Examiner* — Kimberly T Wood
(74) *Attorney, Agent, or Firm* — JCIPRNET

(57) ABSTRACT

A supporter includes: a first plate; a second plate that stands erect from a first edge of the first plate, and changes an angle between the second plate and the first plate when elastically deformed upon receipt of a load; a third plate that extends in a direction away from the first plate from a second edge of the second plate on a higher side, and changes an angle between the third plate and the second plate when elastically deformed upon receipt of a load; a fourth plate that stands erect and extends from a third edge of the third plate on a side away from the first plate, and reduces an angle between the fourth plate and the third plate when elastically deformed upon receipt of a load; and a support portion that is continuous with an upper portion of the fourth plate and supports a to-be-supported object.

12 Claims, 9 Drawing Sheets

(56) References Cited

U.S. PATENT DOCUMENTS

| | | | | |
|---|---|---|---|---|
| 7,555,879 | B1 * | 7/2009 | Utz | B65D 19/44 53/410 |
| 8,052,114 | B2 * | 11/2011 | Saggers | B65D 19/38 248/346.02 |
| 8,616,516 | B2 * | 12/2013 | Rittner | B64C 1/403 248/500 |
| 8,727,300 | B2 * | 5/2014 | Maier | F16M 7/00 248/300 |
| D714,626 | S * | 10/2014 | Trifari, Jr. | D8/382 |
| 8,925,893 | B2 * | 1/2015 | Biedenweg | B60P 7/0807 248/500 |
| 9,049,905 | B2 * | 6/2015 | Perez | A44B 17/0047 |
| 9,163,842 | B2 * | 10/2015 | Adams | A47B 91/08 |
| 2007/0226921 | A1 * | 10/2007 | Turner | B65G 69/30 14/71.1 |
| 2022/0396395 | A1 * | 12/2022 | Kono | B65D 19/44 |
| 2023/0028458 | A1 * | 1/2023 | Endo | B65D 19/44 |

* cited by examiner

SUPPORTER AND CARRIER

CROSS-REFERENCE TO RELATED APPLICATIONS

This application is based on and claims priority under 35 USC 119 from Japanese Patent Application No. 2021-119209 filed Jul. 20, 2021.

BACKGROUND

(i) Technical Field

The present disclosure relates to a supporter and a carrier.

(ii) Related Art

To ship a heavy product, the product is placed on a pallet, and the product on the pallet is raised and transported by a forklift.

In this case, to prevent the product from falling out of the pallet during transportation, the product on the pallet is supported by a supporter called a bracket. Here, a cushioning member such as styrene foam is interposed between the pallet and the product to prevent the product from being damaged by vibrations.

Japanese Unexamined Patent Application Publication No. 10-095429 discloses a bracket with a shape that enables the bracket to be fastened to an apparatus.

SUMMARY

Aspects of non-limiting embodiments of the present disclosure relate to a supporter that is deformable by a larger amount when receiving a load in the direction of gravity to improve the cushioning performance than a structure not including four plates including a first plate, a second plate, a third plate, and a fourth plate with different angles.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a supporter that includes: a first plate; a second plate that stands erect from a first edge of the first plate, and changes an angle between the second plate and the first plate when elastically deformed upon receipt of a load; a third plate that extends in a direction away from the first plate from a second edge of the second plate on a higher side, and changes an angle between the third plate and the second plate when elastically deformed upon receipt of a load; a fourth plate that stands erect and extends from a third edge of the third plate on a side away from the first plate, and reduces an angle between the fourth plate and the third plate when elastically deformed upon receipt of a load; and a support portion that is continuous with an upper portion of the fourth plate and supports a to-be-supported object.

BRIEF DESCRIPTION OF THE DRAWINGS

Exemplary embodiments of the present disclosure will be described in detail based on the following figures, wherein.

DETAILED DESCRIPTION

Now, a comparative example will be described first, and then exemplary embodiments of the present disclosure will be described.

Figure 1A:
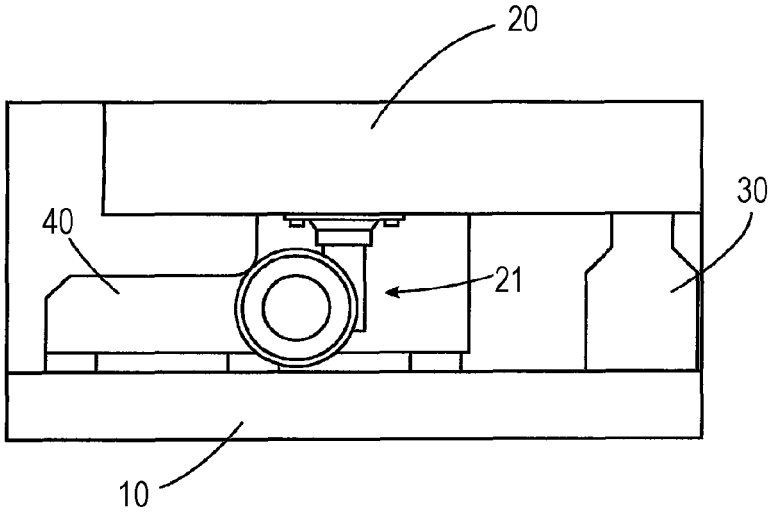
FIGS. 1A, 1B, and 1C are diagrams of a comparative example of a method for supporting a to-be-supported object on a pallet.
Figure 1B:
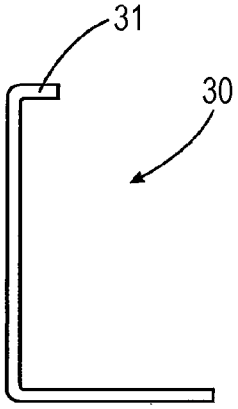
Figure 1C:
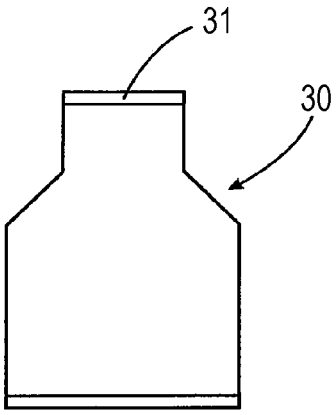

FIGS. 1A, 1B, and 1C illustrate a comparative example of a method for supporting a to-be-supported object on a pallet.

FIG. 1A illustrates part of a bottom of an apparatus 20, serving as an example of a to-be-supported object, on a pallet 10. The apparatus 20 includes casters 21 at a lower portion. The apparatus 20 is protected by a bracket 30 for restricting, for example, horizontal vibrations, and a cushioning member 40 serving as a cushion against vertical vibrations, and transported on the pallet 10.

FIGS. 1B and 1C are a side view and a front view of the bracket 30. The bracket 30 includes a hook 31 at an upper portion. The hook 31 is received in a support opening (not illustrated) of the apparatus 20. The bracket 30 restricts, for example, horizontal vibrations of the apparatus 20 while having the hook 31 received in the support opening of the apparatus 20.

In this comparative example, after the apparatus 20 is placed on the pallet 10, the apparatus 20 is to be supported by two types of supporters including the bracket 30 and the cushioning member 40.

Figure 2:
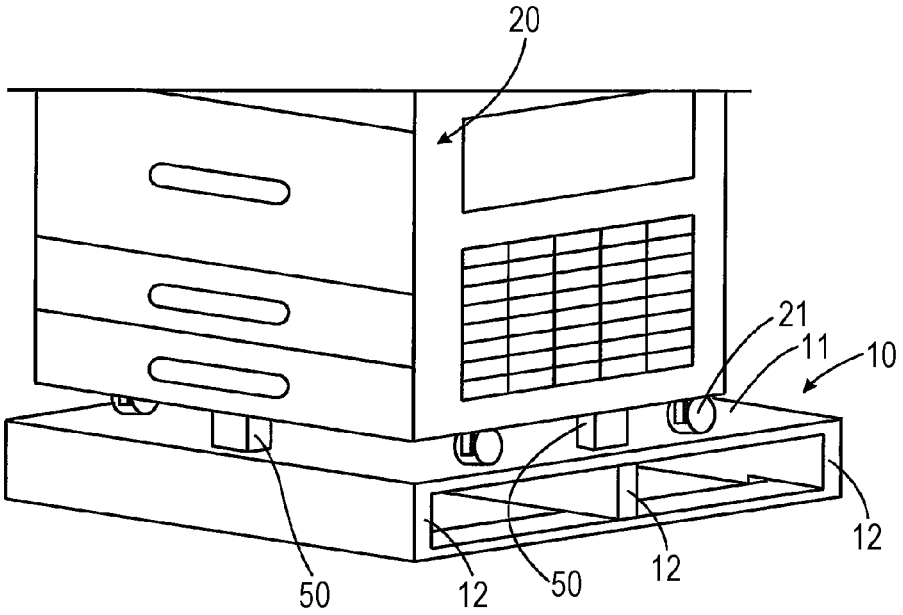
FIG. 2 is a diagram of an example of a method for supporting an apparatus on a pallet with a supporter according to the present exemplary embodiment.

FIG. 2 is a diagram illustrating a method for supporting an apparatus on the pallet with a supporter serving as an example of the present exemplary embodiment.

As in the case of the comparative example illustrated in FIGS. 1A, 1B, and 1C, the apparatus 20 including the casters 21 are placed on the pallet 10. The pallet 10 includes a deckboard 11 and stringers 12 extending while being in contact with the lower surface of the deckboard 11, and receives a to-be-supported object (here, the apparatus 20) to be transported. A pallet (not illustrated) including, instead of the stringers 12, blocks shorter than stringers 12 is also used.

The pallet 10, the deckboard 11, and the stringers 12 (or blocks) correspond to examples of a support base, a deckboard, and stringers in the present disclosure. A combination of the pallet 10 and supporters 50 placed on the stringers 12 (or blocks) with the deckboard 11 interposed therebetween corresponds to an example of a carrier according to the present disclosure.

The apparatus 20 is supported on the pallet 10 by multiple supporters 50 of the same type illustrated in a simplified manner here. Each of the supporters 50 functions both the bracket 30 and the cushioning member 40 illustrated in FIGS. 1A, 1B, and 1C. These supporters 50 are placed at positions overlapping with the stringers 12 with the deckboard 11 of the pallet 10 interposed therebetween. The supporters 50 elastically deform in the manner as will be described later. When the supporters 50 are placed at the positions overlapping the stringers 12, the deckboard 11 bends by a smaller amount. Thus, the supporters 50 deform as intended compared to the case where the supporters 50 are placed at positions deviating from the stringers 12.

The supporter will be described below.

Figure 3:
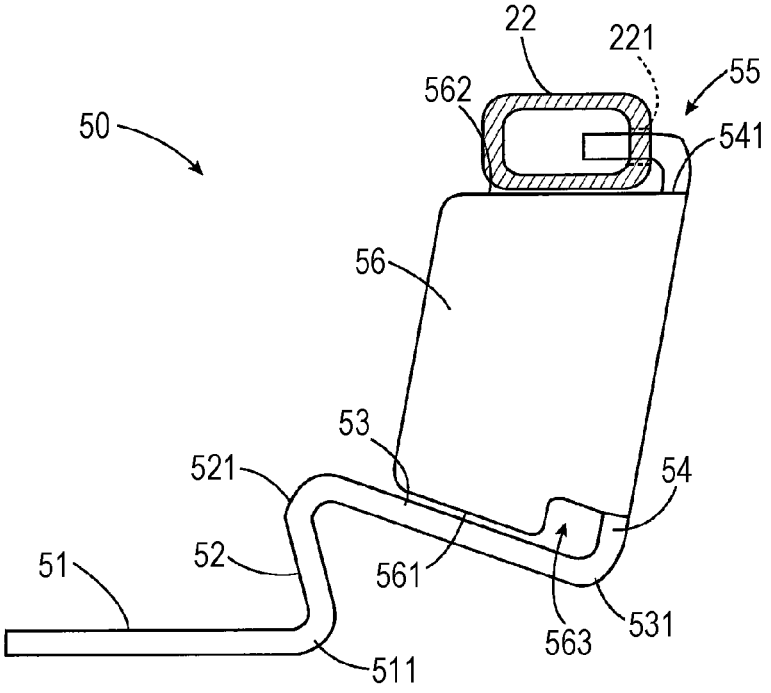
FIG. 3 is a side view of a supporter according to a first exemplary embodiment of the present disclosure.
Figure 4:
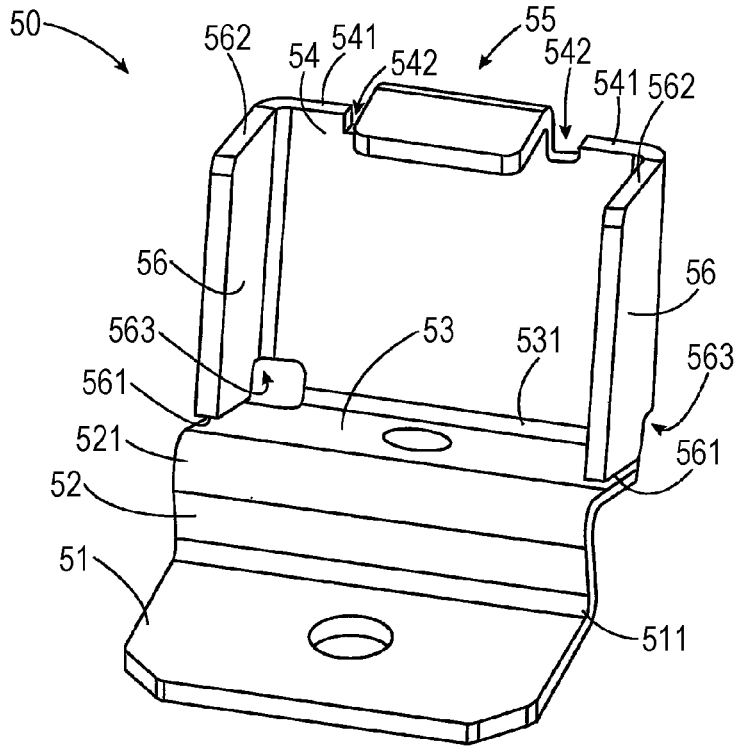
FIG. 4 is a perspective view of the supporter according to the first exemplary embodiment of the present disclosure.

FIGS. 3 and 4 are a side view and a perspective view of a supporter according to a first exemplary embodiment of the present disclosure.

The supporter 50 is formed by processing a sheet metal. Here, the material is not limited to a specific one, and may be plastic for a relatively light to-be-supported object.

The supporter 50 includes a first plate 51, a second plate 52, a third plate 53, a fourth plate 54, and a support portion 55.

The first plate 51 has a hole for fastening the supporter 50 on the pallet 10.

The second plate 52 stands erect from a first edge 511 of the first plate 51. In the present exemplary embodiment, the second plate 52 stands erect from the first edge 511 of the first plate 51, and extends to form an acute angle between itself and the first plate 51. The second plate 52 that extends in a direction to form an acute angle between itself and the first plate 51 is capable of bearing a heavier load than the second plate 52 that would extend in a direction to form an obtuse angle between itself and the first plate 51.

The third plate 53 extends from a second edge 521 of the second plate 52 on a higher side in a direction away from the first plate 51. The third plate 53 changes an angle between itself and the second plate 52 when elastically deformed upon receipt of a load.

The fourth plate 54 stands erect and extends from a third edge 531 of the third plate 53 on a side away from the first plate 51. The fourth plate 54 reduces the angle between itself and the third plate 53 when elastically deformed upon receipt of a load.

The support portion 55 is continuous with the fourth plate 54 and supports a to-be-supported object. Specifically, the support portion 55 is formed from a hook-shaped fifth plate that extends upward from the fourth plate 54, and is bent to extend further. The support portion 55 with the hook shape more reliably supports the to-be-supported object than a structure without a hook shape. Specifically, the hook-shaped support portion 55 is received in a support opening 221 formed in a support frame 22, constituting a lower portion of the apparatus 20 (refer to FIG. 2), to reduce horizontal vibrations of the apparatus 20 including the support frame 22.

The fourth plate 54 is wider than the support portion 55. The fourth plate 54 has a fourth edge 541 on a higher side in which first grooves 542 are recessed downward on both sides of the support portion 55. Compared to a structure not including the first grooves 542, the structure including the first grooves 542 improves the elasticity of the support portion 55 against the horizontal vibrations to avoid breakage.

The supporter 50 also includes sixth plates 56. The sixth plates 56 extend from side edges of the fourth plate 54 along the third plate 53 while having lower end surfaces 561 spaced apart from the third plate 53, and extend under the apparatus 20 while having upper end surfaces 562 spaced apart from the apparatus 20 serving as a to-be-supported object supported by the support portion 55. When the supporter 50 receives a load from the upper side, these sixth plates 56 receive a hit from the apparatus 20 serving as a to-be-supported object on the upper end surfaces 562, and bring the lower end surfaces 561 against the third plate 53 as a result of reducing the angle between the third plate 53 and the fourth plate 54.

By bringing the lower end surfaces 561 against the third plate 53 when receiving a load, the sixth plates 56 prevent an excessive reduction of the angle between the third plate 53 and the fourth plate 54 unlike the structure where the lower end surfaces 561 are not brought against the third plate 53.

Figure 5:
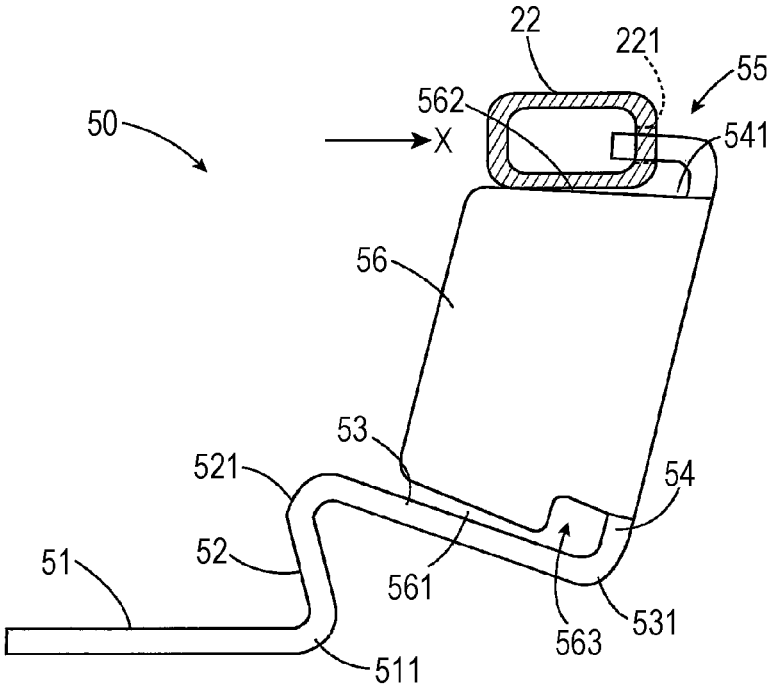
FIG. 5 is a schematic diagram illustrating the behavior of the supporter when an apparatus serving as a to-be-supported object receives a load in the horizontal direction.

FIG. 5 is a schematic diagram illustrating the behavior of the supporter when the apparatus serving as a to-be-supported object receives a load in the horizontal direction.

When the apparatus 20 including the support frame 22 moves in the horizontal direction indicated with arrow X in FIG. 5, the supporter 50 is more likely to deform to have the hook portion of the support portion 55 opening upward, and the hook-shaped support portion 55 is more likely to be removed from the support opening 221. At this time, as illustrated in FIG. 5, the support frame 22 of the apparatus 20 comes into contact with the upper end surfaces 562 of the sixth plates 56 to prevent the support portion 55 from being deformed in a direction to be unhooked from the support opening 221.

Thus, the present exemplary embodiment prevents removal of the support portion 55 from the apparatus 20 serving as a to-be-supported object due to an excessive deformation unlike in a structure where the upper end surfaces 562 do not receive any hit from the apparatus 20 when receiving a load in the horizontal direction.

The sixth plates 56 include a pair of sixth plates respectively continuous with the left and right side edges of the fourth plate 54. The pair of sixth plates 56 with this structure deform in a well-balanced manner on the left and right sides compared to a structure where the sixth plate 56 includes only one plate extending from one side edge of the fourth plate 54.

Here, the lower end surface 561 of each sixth plate 56 corresponds to an example of a hitting portion in the present disclosure. The upper end surface 562 of each sixth plate corresponds to an example of a hit portion in the present disclosure.

Each sixth plate 56 has a second groove 563, which is recessed upward at a portion of the lower end surface 561 continuous with the fourth plate 54. Unlike a structure without the second groove 563, the sixth plate 56 with the second groove 563 is adjusted to reduce the spring force for elastic deformation until the lower end surface 561 of the sixth plate 56 hits against the third plate 53.

The supporter 50 is capable of approximately halving the costs for components or manpower before transportation compared to a structure including the bracket 30 and the cushioning member 40 described with reference to FIGS. 1A, 1B, and 1C. The supporter 50 achieves the intended cushioning performance.

Supporters according to some exemplary embodiments including a second exemplary embodiment will be described now. In the following description, reference signs the same as those for the supporter 50 according to the first exemplary embodiment are used, and only the points different from the supporter 50 according to the first exemplary embodiment will be described.

Figure 6:
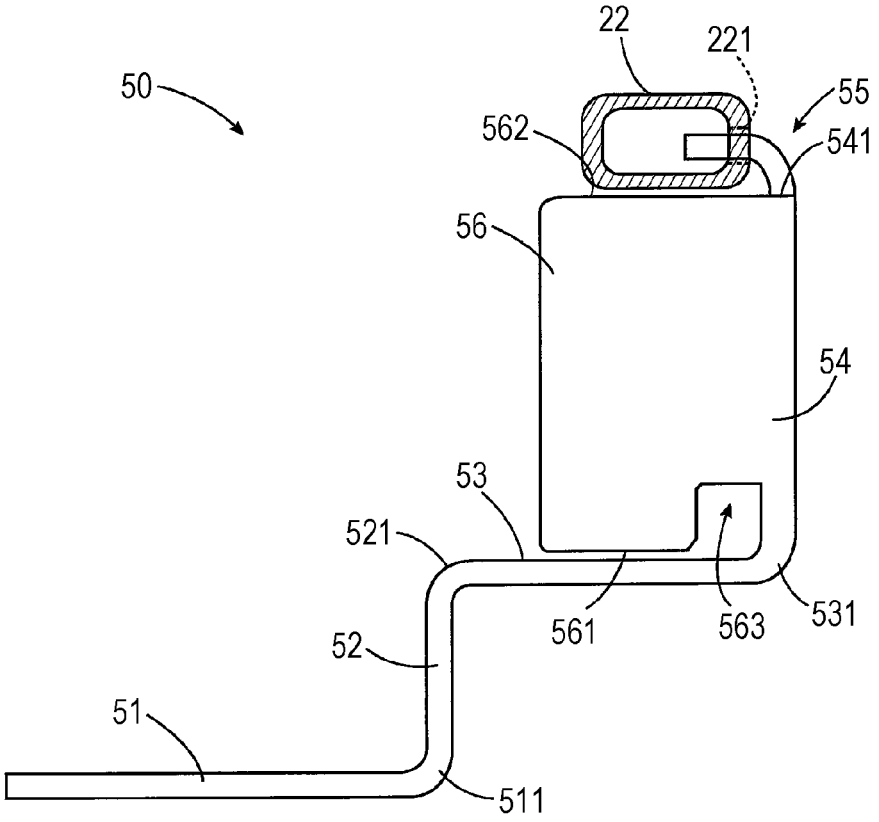
FIG. 6 is a side view of a supporter according to a second exemplary embodiment of the present disclosure.
Figure 7:
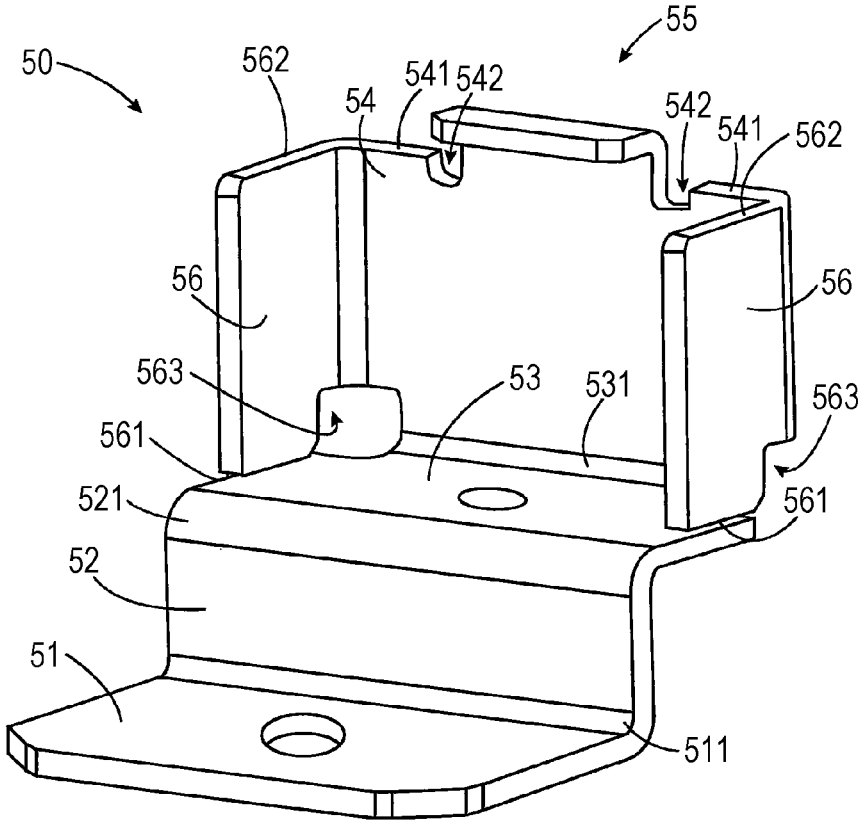
FIG. 7 is a perspective view of the supporter according to the second exemplary embodiment of the present disclosure.

FIGS. 6 and 7 are a side view and a perspective view of a supporter according to a second exemplary embodiment of the present disclosure.

A second plate 52 of a supporter 50 according to the second exemplary embodiment stands substantially perpendicular to the first edge 511 of the first plate 51, and a third plate 53 extends from a second edge 521 of the second plate 52 on a higher side in a direction substantially horizontally away from the first plate 51.

In the supporter 50 according to the first exemplary embodiment, the second plate 52 extends in a direction to form an acute angle between itself and the first plate 51. In this case, when receiving a load, the second plate 52 deforms to further reduce the angle between itself and the first plate 51. In contrast, in the supporter 50 according to the second exemplary embodiment, when receiving a load, the second plate 52 deforms to increase the angle between itself and the first plate 51. Regardless of when deforming to increase the angle between itself and the first plate 51, the supporter 50 supports the apparatus 20 serving as a to-be-supported object, and exerts its cushioning performance. As described above, instead of an acute angle, the angle between the second plate 52 and the first plate 51 may be substantially a right angle as in the second exemplary embodiment. Alternatively, although not illustrated, the first plate 51 and the second plate 52 may form an obtuse angle.

Figure 8:
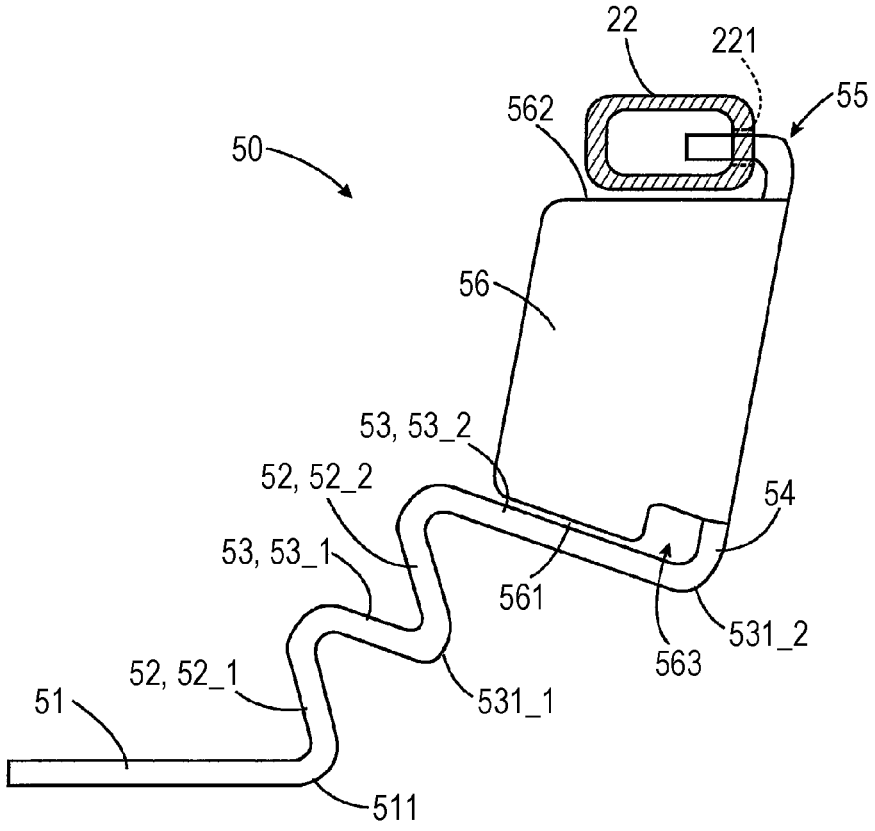
FIG. 8 is a side view of a supporter according to a third exemplary embodiment of the present disclosure.

FIG. 8 is a side view of a supporter according to a third exemplary embodiment of the present disclosure.

A supporter 50 according to a third exemplary embodiment illustrated in FIG. 8 includes two sets of the second plate 52 and the third plate 53: a first set including a first-set second plate 52_1 and a first-set third plate 53_1, and a second set including a second-set second plate 52_2 and a second-set third plate 53_2. Here, the second-set second plate 52_2 stands erect from a third edge 531_1 of the first-set third plate 53_1. The fourth plate 54 extends from a third edge 531_2 of the second-set third plate 53_2.

The supporter 50 according to the third exemplary embodiment, including two sets of the second plate 52 and the third plate 53, increases the amount of elastic deformation further than the structure simply including one set of the second plate 52 and the third plate 53.

Although the supporter 50 including two sets of the second plate 52 and the third plate 53 has been described here, the supporter 50 may include three or more sets of the second plate 52 and the third plate 53 while having the second plate in the second or subsequent set standing erect from the third edge of the third plate in the former set.

Figure 9:
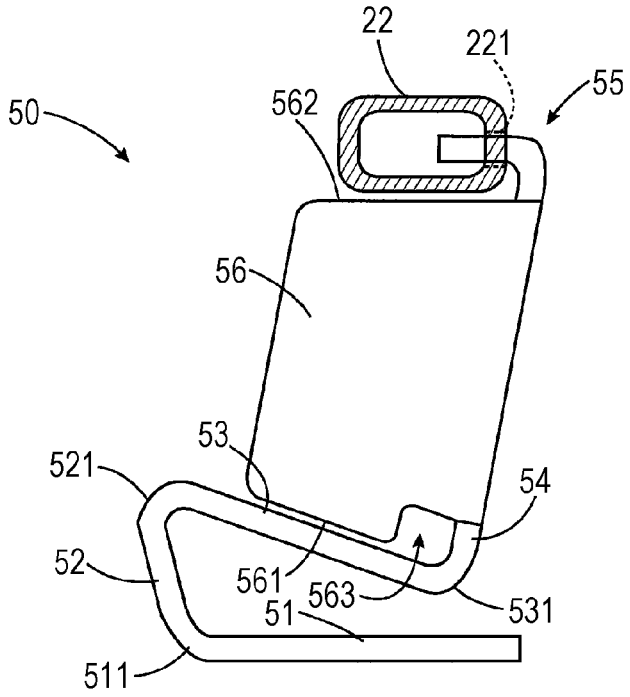
FIG. 9 is a side view of a supporter according to a fourth exemplary embodiment of the present disclosure.

FIG. 9 is a side view of a supporter according to a fourth exemplary embodiment of the present disclosure.

In the supporter 50 according to the first exemplary embodiment, the second plate 52 stands erect from the rear edge of the first plate 51. In the supporter 50 according to the fourth exemplary embodiment illustrated in FIG. 9, the second plate 52 stands erect from the front edge of the first plate 51 serving as a first edge 511.

The supporter 50 illustrated in FIG. 9 also supports the apparatus 20 serving as a to-be-supported object and exerts the cushioning performance.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A supporter comprising:

a first plate;

a second plate that stands erect from a first edge of the first plate, and changes an angle between the second plate and the first plate when elastically deformed upon receipt of a load;

a third plate that extends in a direction away from the first plate from a second edge of the second plate on a higher side, and changes an angle between the third plate and the second plate when elastically deformed upon receipt of a load;

a fourth plate that stands erect and extends from a third edge of the third plate on a side away from the first plate, and reduces an angle between the fourth plate and the third plate when elastically deformed upon receipt of a load; and a support portion that is continuous with an upper portion of the fourth plate and supports a to-be-supported object, wherein the first plate includes a hole penetrating the first plate, wherein the second plate extends from a first edge of the first plate in a direction to form a right angle or an acute angle between the second plate and the first plate, wherein the support portion is formed from a hook-shaped fifth plate extending upward from the fourth plate, and bent to extend further, wherein the fourth plate is wider than the support portion, and has first grooves recessed downward on both sides of the support portion.

2. The supporter according to claim 1, further comprising:

a hitting portion extending from a side edge of the fourth plate along the third plate and at a distance from the third plate, the hitting portion hitting against the third plate when an angle between the third plate and the fourth plate is reduced.

3. The supporter according to claim 1, further comprising:

a hit portion extending from a side edge of the fourth plate under the to-be-supported object supported by the support portion at a distance from the to-be-supported object, the hit portion receiving a hit from the to-be-supported object when elastically deformed upon receipt of a load.

4. The supporter according to claim 1, comprising:

a sixth plate extending from a side edge of the fourth plate, having a lower end surface extending along the third plate at a distance from the third plate, and having an upper end surface extending under a to-be-supported object supported by the support portion at a distance from the to-be-supported object, wherein the sixth plate brings the lower end surface against the third plate when an angle between the third plate and the fourth plate is reduced, and receives a hit on the upper end surface from the to-be-supported object when elastically deformed upon receipt of a load while bringing the lower end surface against the third plate.

5. The supporter according to claim 4, wherein the sixth plate has a second groove recessed upward at a portion of the lower end surface continuous with the fourth plate.

6. The supporter according to claim 4, wherein the sixth plate includes a pair of sixth plates continuous with left and right side edges of the fourth plate.

7. A carrier, comprising:

a support base including a deckboard and a stringer extending while being in contact with a lower surface of the deckboard, the support base receiving a to-be-supported object to be transported; and the supporter according to claim 1 disposed at a position on an upper surface of the deckboard overlapping the stringer with the deckboard interposed therebetween.

8. A supporter comprising:

a first plate;

a second plate that stands erect from a first edge of the first plate, and changes an angle between the second plate and the first plate when elastically deformed upon receipt of a load;

a third plate that extends in a direction away from the first plate from a second edge of the second plate on a higher side, and changes an angle between the third plate and the second plate when elastically deformed upon receipt of a load;

another second plate standing erect from a third edge of the third plate;

another third plate that extends in a direction away from the first plate from another second edge of the another second plate on a higher side, and changes an angel between the another third plate and the another second plate when elastically deformed upon receipt of a load;

a fourth plate that stands erect and extends from another third edge of the another third plate on a side away from the first plate, and reduces an angle between the fourth plate and the another third plate when elastically deformed upon receipt of a load; and a support portion that is continuous with an upper portion of the fourth plate and supports a to-be-supported object, wherein the first plate includes a hole penetrating the first plate.

9. The supporter according to claim 8, wherein the support portion is formed from a hook-shaped fifth plate extending upward from the fourth plate, and bent to extend further.

10. The supporter according to claim 9, wherein the fourth plate is wider than the support portion, and has first grooves recessed downward on both sides of the support portion.

11. The supporter according to claim 8, further comprising:

a hitting portion extending from a side edge of the fourth plate along the third plate and at a distance from the third plate, the hitting portion hitting against the third plate when an angle between the third plate and the fourth plate is reduced.

12. A supporter comprising:

a first plate;

a second plate that stands erect from a first edge of the first plate, and changes an angle between the second plate and the first plate when elastically deformed upon receipt of a load;

a third plate that extends in a direction away from the first plate from a second edge of the second plate on a higher side, and changes an angle between the third plate and the second plate when elastically deformed upon receipt of a load;

a fourth plate that stands erect and extends from a third edge of the third plate on a side away from the first plate, and reduces an angle between the fourth plate and the third plate when elastically deformed upon receipt of a load; and a support portion that is continuous with an upper portion of the fourth plate and supports a to-be-supported object, wherein the support portion is formed from a hook-shaped fifth plate extending upward from the fourth plate, and bent to extend further wherein the fourth plate is wider than the support portion, and has first grooves recessed downward on both sides of the support portion.

* * * * *